US006364242B1

(12) United States Patent
Braun et al.

(10) Patent No.: US 6,364,242 B1
(45) Date of Patent: Apr. 2, 2002

(54) ROTOR WINDER

(75) Inventors: Martin Braun, Kreuztal; Dieter Rosenthal, Niederfischbach; Reinhard Irle, Hilchenbach; Adolf Müller, Wilnsdorf, all of (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/485,746

(22) PCT Filed: Aug. 13, 1998

(86) PCT No.: PCT/EP98/05152

§ 371 Date: Apr. 18, 2000

§ 102(e) Date: Apr. 18, 2000

(87) PCT Pub. No.: WO99/08815

PCT Pub. Date: Feb. 25, 1999

(30) Foreign Application Priority Data

Aug. 15, 1997 (DE) ..... 197 36 260
Aug. 10, 1998 (DE) ..... 198 36 159

(51) Int. Cl.[7] ..... B65H 18/16; B65H 19/28; B65H 19/30

(52) U.S. Cl. ..... 242/532; 242/532.2; 242/533.4; 242/542.2

(58) Field of Search ..... 242/532, 532.2, 242/533.4, 533.5, 533.6, 542.2

(56) References Cited

U.S. PATENT DOCUMENTS 3,794,256 A * 2/1974 Schwarz ..... 242/532
4,058,267 A * 11/1977 Schuttler ..... 242/532
4,964,587 A * 10/1990 Oki et al. ..... 242/532
5,149,004 A * 9/1992 Sudau et al. ..... 242/532
6,082,659 A * 7/2000 Sankaran et al. ..... 242/532

FOREIGN PATENT DOCUMENTS

EP 0707904 4/1996
GB 952449 3/1964

OTHER PUBLICATIONS

Patent Abstracts of Japan, vol. 013, No. 420 (M–872), Sep. 19, 1989 & JP 01 157713 A (Hitachi Ltd), Jun. 21, 1989.
Patent Abstracts of Japan, vol. 007, No. 079 (M–204), Mar. 31, 1983 & JP 58 006725 A (Hitachi Seisakusho KK). Jan. 14, 1983.

* cited by examiner

*Primary Examiner*—John M. Jillions
(74) *Attorney, Agent, or Firm*—Friedrich Kueffner

(57) ABSTRACT

A rotor winder and a method for operating the rotor winder, wherein the rotor winder has two rotors supported in a rotatable rotor with two winders which are driven independently from one another and are provided for successive continuous winding of hot strip. Each winder has a winder mandrel including several moveable segments for expanding the winder mandrel, wherein the segments are supported on axially moveable wedge-shaped gliding surfaces. The winders are moveable in cycles from an initial position into the coil transfer position by rotation of the rotor. A device is provided for guiding an incoming hot strip onto the winder mandrel of the winder positioned in the initial position and for holding the strip on the winder mandrel until a slip-free engagement of the strip is effected. The device for guiding and placing the incoming strip is arranged on a power-driven frame mounted so as to be moveable in a direction extending parallel to the axis of the winder.

15 Claims, 4 Drawing Sheets

ROTOR WINDER

BACKGROUND OF THE INVENTION

1. Field of the Invention

The invention relates to a rotor winder with two winders, supported in a rotatable rotor, driven independently from one another, and provided for successive continuous winding of hot strip, wherein each winder comprises a winder mandrel comprised of several moveable segments for expanding the winder mandrel which are supported on axially movable wedge-shaped gliding surfaces, wherein the winders are moveable in cycles from an initial position into the coil transfer position by rotation of the rotor, and with devices for guiding an incoming hot strip onto the winder mandrel of the winder positioned in the initial position and for holding it on the winder mandrel until slip-free engagement of the strip.

2. Description of the Related Art

European patent 0 221 373 discloses a rotor winder for cold strip which, however, concerns the expansion and contraction of the winder mandrel.

European patent document 0 707 904 discloses a device for start-up winding strip-shaped rolling stock which is pressed against the winder mandrel by an endless tooth chain embracing partially the first windings of the coil to be wound. The deflection chain can easily cause damage to the leading end of the strip and also wear on the winder mandrels. Such deflection chains are especially not suitable for winding hot strip. Even though these devices for start-up winding of strip-shaped rolling stock are supposedly suitable for carousel winders, there is the risk that, when in the start-up winding position strip should be wound longer, the strip could come into contact with the device for holding the strip on the winder, when pivoted into the open position. In any case, it is impossible to wind in an emergency situation the complete coil in the start-up winding position.

SUMMARY OF THE INVENTION

The present invention therefore has the object to design a rotor winder for hot strip such that very thin, quickly moving hot strips can be wound without breaking out and substantially without damage caused by the device for start-up winding, wherein it is to be ensured that in an emergency situation a complete coil can be wound in the initial position of the winder. As a solution to this object it is suggested according to the invention that the device for guiding and placing the incoming strip is arranged on a power-driven carriage moveable in a direction that is axis-parallel to the winder.

Because the device for guiding and placing the incoming strip is arranged on a carriage, which can be moved completely out of the winding position, the device can no longer be a disturbance when in an emergency situation a complete coil must be wound in the initial position of the winder.

In order to prevent damage to the strip and to ensure a safe start-up winding, pressure rollers as well as deflection cups are arranged on the carriage, wherein the pressure rollers preferably have a slightly greater velocity than the strip transport velocity so that breaking out of the strip cannot occur. Possible damage and buckling of the strip, for example, at the deflection cups, are prevented in that the deflection cups are loaded with a medium which is directed toward the strip, preferably in the strip transport direction, via nozzles at the deflection cups so that the strip is forced away from the deflection cups against the winder mandrel.

BRIEF DESCRIPTION OF THE DRAWING

The invention will be explained in more detail with the aid of the drawing. It is shown in.

DESCRIPTION OF THE PREFERRED EMBODIMENTS

Figure 1:
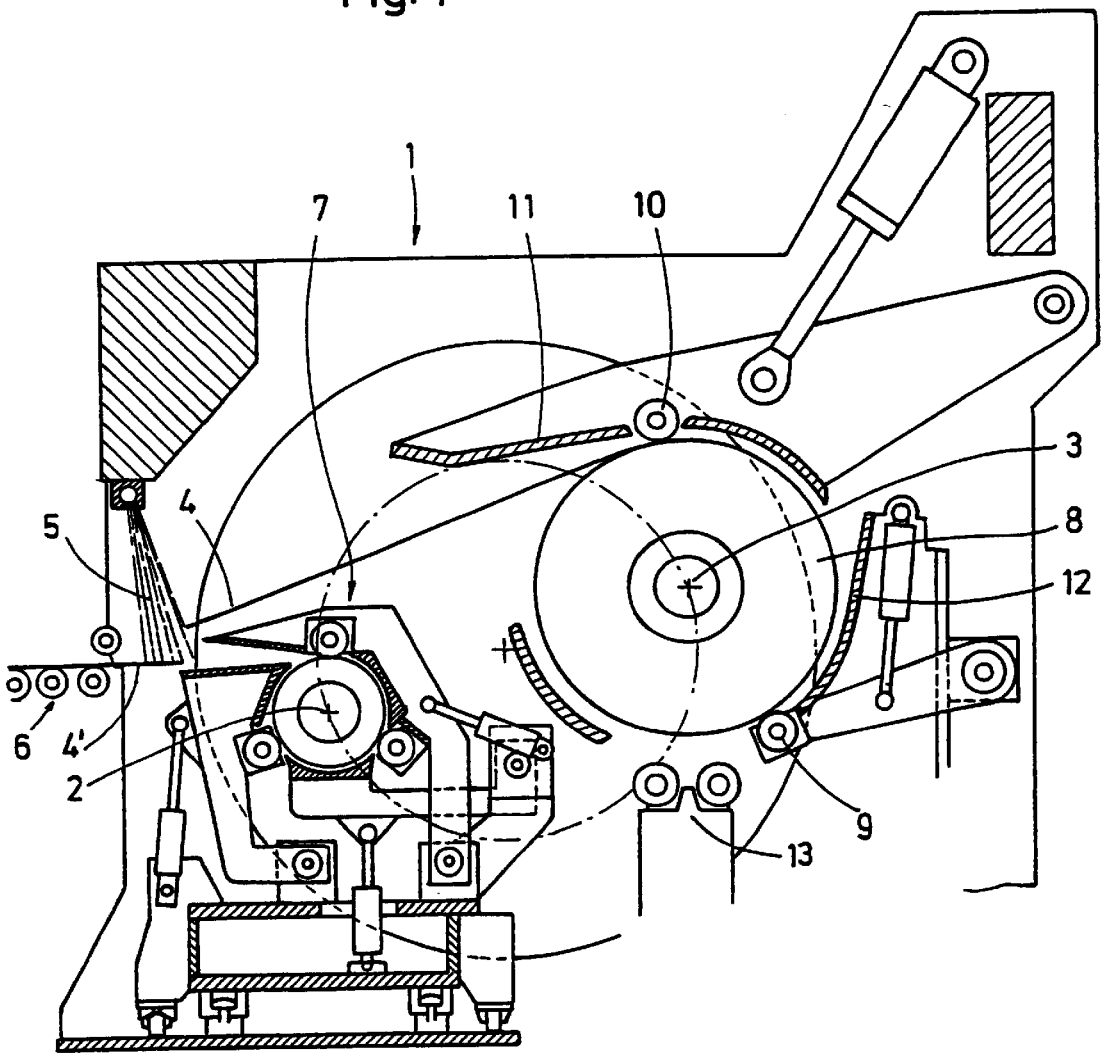
FIG. 1 a rotor winder with a coil to be started in the initial position and a finish-wound coil provided at the coil transfer position, FIG. 2 a section view of the device for guiding and placing the incoming strip in a rotor winder, FIG. 3 a side view of the device for guiding and placing the incoming strip, FIG. 4 an alternative to the device for guiding and placing an incoming strip shown in FIG. 2.

FIG. 1 shows a rotor winder 1, having a winder 2 in the initial position and a winder 3 in the coil transfer position. The hot strip 4 coming from a mill train is pressed by a medium 5, e.g. air or water, onto the roller table 6. The velocity of the very thin hot strip can be e.g. 20 m/sec. In the initial position of the winder 2 the winding of the hot strip 4 is started. A device 7 for guiding and placing the incoming strip is provided in order to wind the first windings of the coil to be wound securely and without slip onto the winder 2.

In the coil transfer position a finish-wound coil 8 on the winder 3 is shown. Strip end rollers 9, 10, which are arranged on catch cups 11, 12 that can be pivoted toward the coil 8, are driven with a slightly reduced velocity relative to the strip velocity so that it is ensured that the end of the strip will not flap about the winder 3 but will securely rest against the coil. After completion of the coil 8 and after pivoting away the mandrel support bearing (not shown), the coil can be removed from the winder 3 via the coil carriage 13.

The coil which has now been started in the initial position can be pivoted into the coil transfer position, where the coil 8 is finish-wound, by pivoting the winder 2 into the position of the winder 3, after moving the device 7 for guiding and placing the incoming strip 4 out of the rotor winder 1, and by pivoting the winder 3 into the position of the winder 2.

Figure 2:
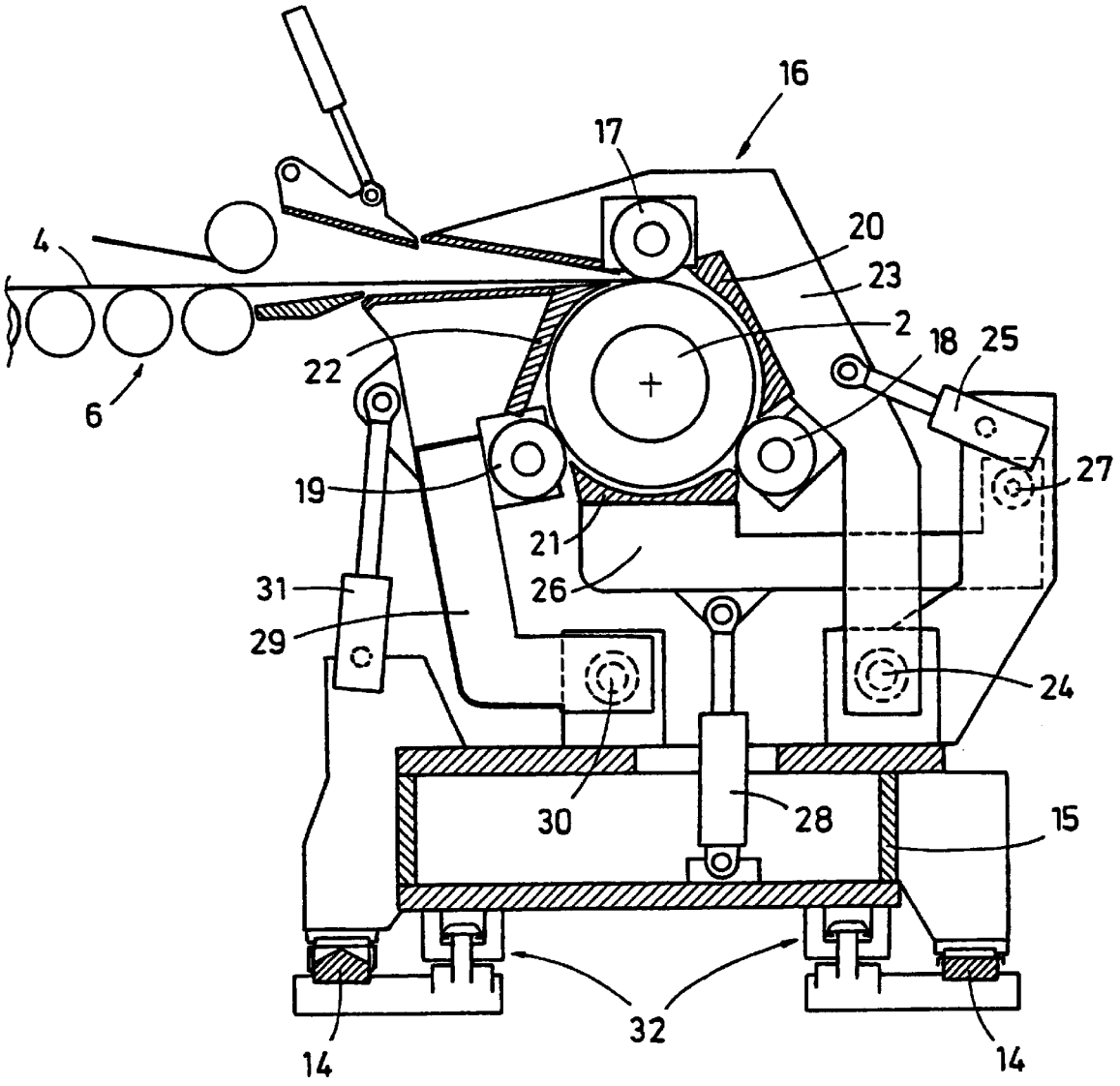

FIG. 2 shows the device 7 for guiding and placing the incoming strip. It is comprised of a frame 15 that is movable on rails 14 and has the start-up winding unit 16 arranged thereon. The start-up winding unit 16 is comprised of pressure rollers 17, 18, 19 and deflection cups 20, 21, 22. The pressure roller 17 as well as the deflection cup 20 are fastened on a pivot arm 23 and are pivoted together with it by a piston-cylinder-unit 25 about a fixed pivot point 24 on the frame 15. Similarly, the pressure roller 18 as well as the deflection cup 21 are supported on a pivot arm 26 which is pivotable about a pivot point 27 by a piston-cylinder-unit 28. The pressure roller 19 as well as the deflection cup 22 are also supported on a pivot arm 29 which is pivotable by a piston-cylinder-unit 31 about the pivot point 30. The piston-cylinder-units 25, 28, 31 can pivot the pressure rollers 17 through 19 and deflection cups 20 through 22 in a position-controlled manner from the start-up winding position into an open position. After introduction of the leading end of the strip the piston-cylinder-units 25, 28, 31 can be switched to pressure control. This includes the possibility that the spacing between the winding mandrels and the position-controlled pressure rollers before introduction of the tip of the strip is reduced within the winder from the pressure roller 17 to the pressure roller 19 so that an inlet funnel is formed.

In the start-up winding position the frame 15 is secured by hydraulically driven securing devices 32 so that no movement of the frame and of the start-up winding unit 16 in the axial direction of the winder can occur. Alternatively, the securing action can also be realized with the aid of wedge surfaces loaded by the displacement cylinder.

Figure 3:
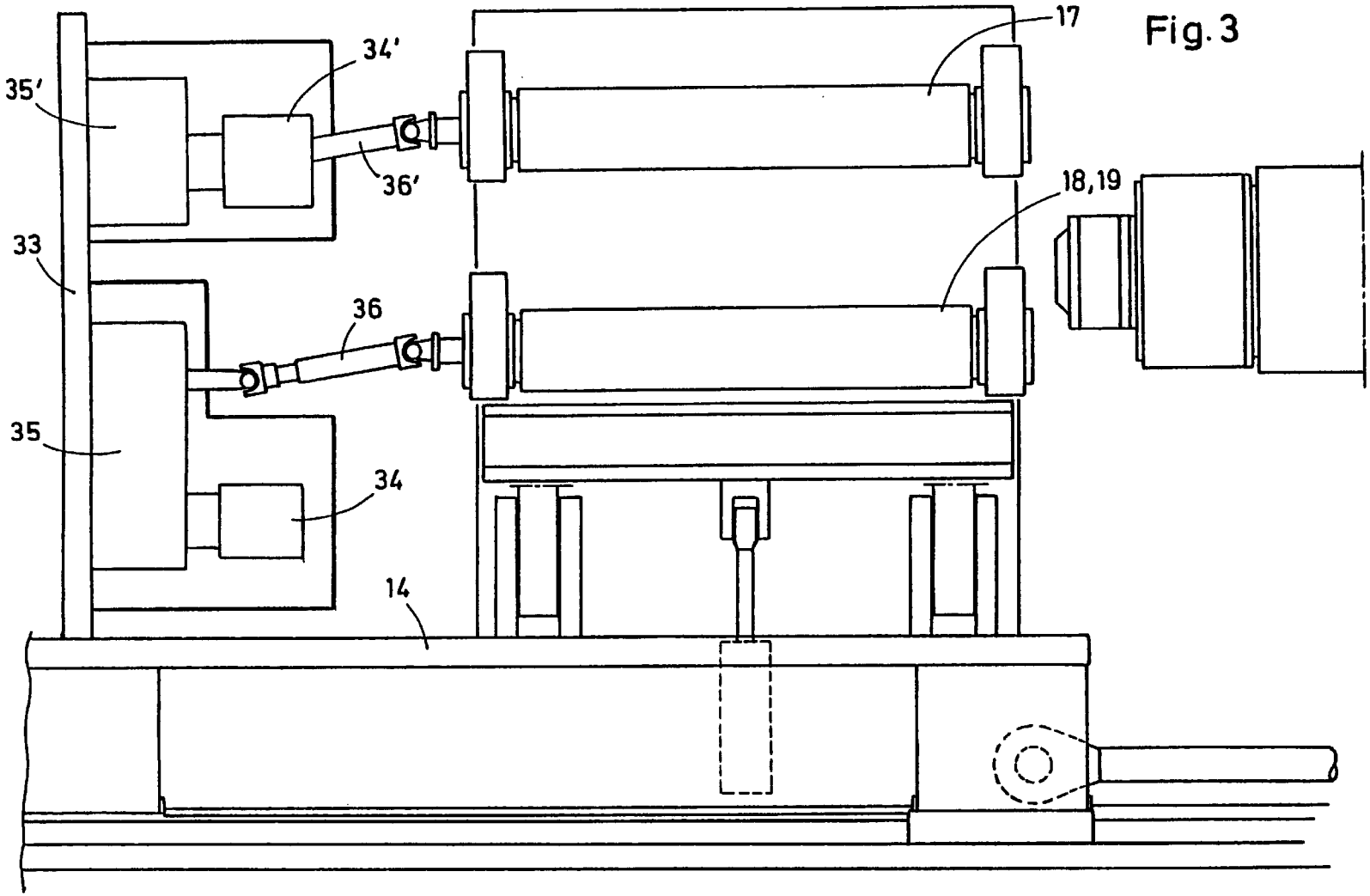

FIG. 3 shows a side view of the frame 14 which has a console 33. The console 33 secures the motors 34, 34' as well as the gear boxes 35, 35' for the pressure rollers 17, 18, and 19, wherein the pressure roller 19 cannot be seen in FIG. 3. Between the gear boxes 35, 35' and the pressure rollers 17, 18, jointed shafts 36, 36' are provided which, on the one hand, establish the rotary drive of the pressure rollers 17 and 18 and, on the other hand, are able to compensate the pivot movement of the pressure rollers 17 and 18 and of the deflection cups 20 and 21 (not shown).

Figure 4:
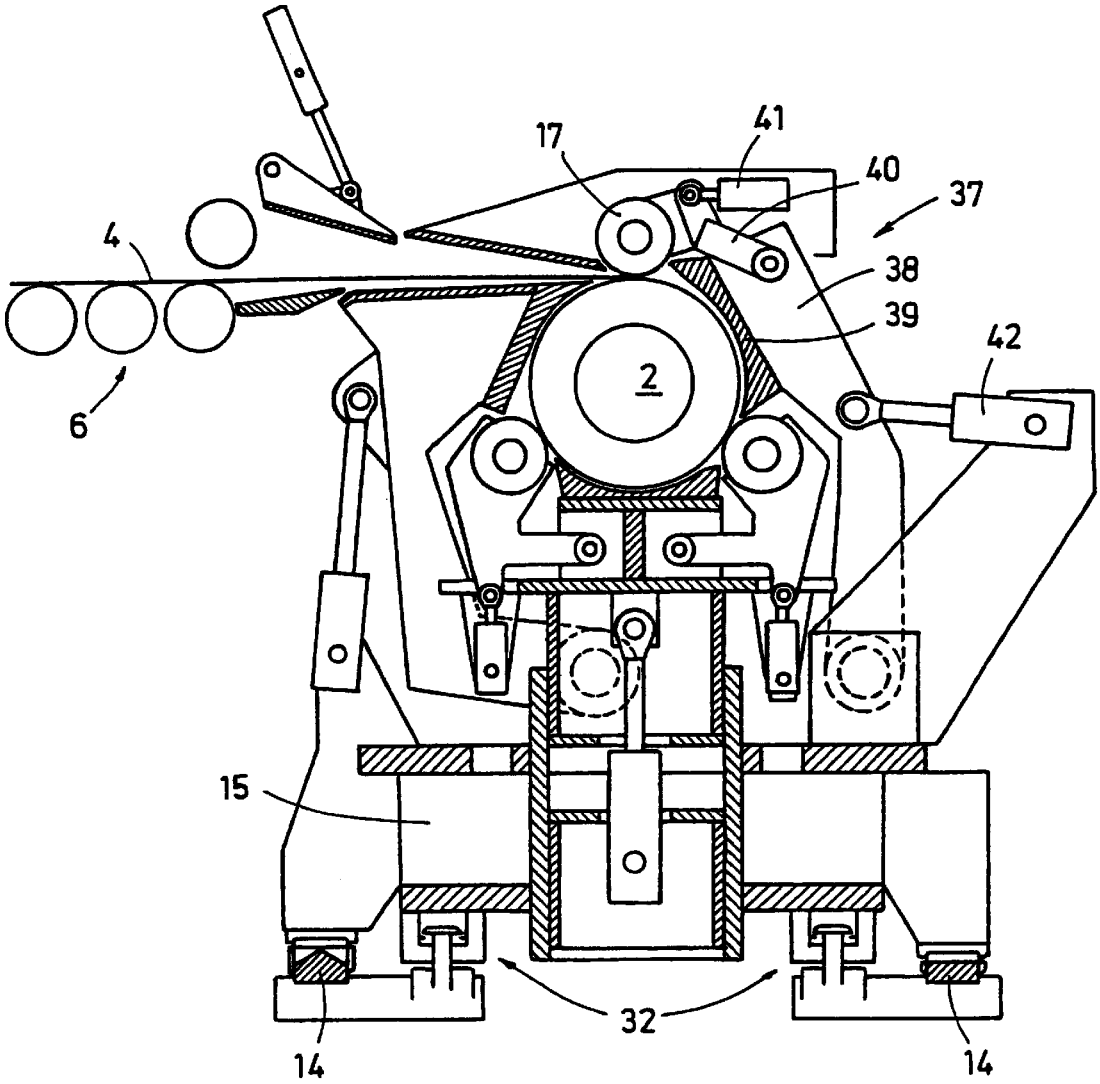

FIG. 4 shows a start-up winding unit 37 which is an alternative to the start-up winding unit 16. The winding unit 37 is also secured on a frame 15 that is movable on rails 14. Here also a pivot arm 38 is provided which supports the deflection cup 39. At the end of the pivot arm 38 however a bearing lever 40 is provided which supports the pressure roller 17. The bearing lever 40 is pivotable relative to the pivot arm 38 by means of a piston-cylinder-unit 41 so that the pressure roller 17 can be pivoted independently of the bearing cup 39 toward the winder 2. In this way, the piston-cylinder unit 42 which drives the pivot arm 38 can be position-controlled and the piston-cylinder-unit 41, which serves to apply pressure to the pressure roller 17, can be operated by position and pressure control. The other pressure rollers as well as deflection cups can be secured and driven similarly.

The kinematic system of the separate pressure roller supporting action on bearing levers 40 independent of the deflection cups 39 allows, because of the minimal mass, a finely adjustable and fast response adaptation of the pressure rollers 17 through 19 upon starting the winding process of thin strips with great velocity while protecting at the same time the strip surface.

OVERVIEW OF REFERENCE NUMERALS

1 rotor winder
2 winder
3 winder
4 hot strip
5 medium
6 roller table
7 device
8 coil
9 roller for strip end
10 roller for strip end
11 catch cup
12 catch cup
13 coil carriage
14 rail
15 frame
16 start-up winding unit
17 pressure roller
18 pressure roller
19 pressure roller
20 deflection cup
21 deflection cup
22 deflection cup
23 pivot arm
24 pivot point
25 piston-cylinder-unit
26 pivot arm
27 pivot point
28 piston-cylinder-unit
29 pivot arm
30 pivot point
31 piston-cylinder-unit
32 securing device
33 console
34 motor
35 gear box
36 jointed shaft
37 start-up winding unit
38 pivot arm
39 deflection cup
40 bearing lever
41 piston-cylinder-unit
42 piston-cylinder-unit

We claim:

1. A rotor winder comprising two rotors supported in a rotatable rotor with two winders, the winders being driven independently from one another and provided for successive continuous winding of hot strip, each winder comprising a winder mandrel comprised of several moveable segments for expanding the winder mandrel, the segments being supported on axially moveable wedge-shaped gliding surfaces, wherein the winders are moveable in cycles from an initial position into a coil transfer position by rotation of the rotor, and a device for guiding an incoming hot strip onto the winder mandrel of the winder positioned in the initial position and for holding the strip on the winder mandrel until a slip-free engagement of the strip is effected, wherein the device for guiding and placing the incoming strip is arranged on a power-driven frame mounted so as to be moveable in a direction extending parallel to an axis of the winder.

2. The rotor winder according to claim 1, wherein the frame is guided on a guideway.

3. The rotor winder according to claim 1, wherein the frame is supported on rails.

4. The rotor winder according to claim 1, wherein the frame comprises a securing device for securing the frame in at least one of an active position and an extreme position thereof.

5. The rotor winder according to claim 1, wherein the frame comprises power-driven pivotable arms for supporting at least one of pressure rollers and deflection cups.

6. The rotor winder according to claim 5, comprising rotary drives for the pressure rollers mounted on the frame.

7. The rotor winder according to claim 6, wherein the rotary drives are comprised of motors, gear boxes and drive shafts.

8. The rotor winder according to claim 1, further comprising an inlet roller table, wherein a guiding flap is arranged in an inlet area of the initial position of the winder, the guiding flap being pivotable against the inlet roller table.

9. The rotor winder according to claim 8, wherein pressure medium nozzles oriented toward the roller table are mounted in the inlet area of the initial position of the winder.

10. The rotor winder according to claim 5, wherein the deflection cups have correlated therewith pressure medium nozzles oriented toward the winder mandrel.

11. A method of operating a rotor winder having two rotors supported in a rotatable rotor with two winders, the winders being driven independently from one another and provided for successive continuous winding of hot strip, each winder having a winder mandrel comprised of several moveable segments for expanding the winder mandrel, the segments being supported on axially moveable wedge-shaped gliding surfaces, wherein the winders are moveable in cycles from an initial position into a coil transfer position by rotation of the rotor, and a device for guiding an incoming hot strip onto the winder mandrel of the winder positioned in the initial position and for holding the strip on the winder mandrel until a slip-free engagement of the strip is effected, wherein the device for guiding and placing the incoming strip is arranged on a power-driven frame mounted so as to be moveable in a direction extending parallel to an axis of the winder, the method comprising, for receiving a hot strip to be wound, moving a free winder mandrel into the initial position and, after reaching this position, moving the frame under the winder mandrel and securing the frame in its position, pivoting the device for guiding and placing the hot strip into an active position, and, after a leading end of the strip has been detected on the winding mandrel, lifting off the device for guiding and placing the hot strip into a rest position and subsequently moving the frame into an extreme position opposite an end face of the winder mandrel, releasing the winder mandrel in the extreme position, and moving the winder mandrel into a coil transfer position during further winding by a rotation of the rotor.

12. The method according to claim 11, wherein the frame has power-driven pivotable arms for supporting pressure rollers and deflection cups, further comprising expanding the winder mandrel for detecting the leading end of the strip on the winder mandrel, adjusting the pressure rollers relative to the winder mandrel to a gap of about 4 to 10 times the thickness of the strip, adjusting the deflection cups to form a gap of about 15 to 20 mm relative to the winder mandrel, applying a medium directed toward the strip against the deflection cups during a start-up winding process, further expanding the winder mandrel after receiving the leading end of the strip, and, after the tension build-up in the strip, spacing the pressure rollers and the deflection cups about 300 mm from the winder.

13. The method according to claim 12, comprising performing with position-control the expansion movement of the winder mandrel and the movement of the pressure rollers and of the deflection cups.

14. The method according to claim 11, comprising expanding the winder mandrel to a maximum diameter for obtaining a circular shape, adjusting the pressure rollers relative to the winder mandrel to have a gap equal to the strip thickness plus about 1 mm, applying a medium directed toward the strip against the deflection cups during the start-up of winding, successively switching the pressure rollers to pressure application after the leading end of the strip has passed, and, after tension build-up in the strip, spacing the pressure rollers and the deflection cups about 300 mm from the winder.

15. The method according to claim 14, comprising position-controlling the expansion movement of the winder mandrel and the spacing of the pressure rollers and of the deflection cups from the winder mandrel, and performing a pressure control after switching the pressure rollers to pressure application.

* * * * *